US006511033B2

(12) United States Patent
Li

(10) Patent No.: US 6,511,033 B2
(45) Date of Patent: Jan. 28, 2003

(54) ROTATION LOCKER STAND FOR OUTDOOR UMBRELLAS

(76) Inventor: Wanda Ying Li, 6822 Milwood Ave., Suite 05, Canoga Park, CA (US) 01303

( * ) Notice: Subject to any disclaimer, the term of this patent is extended or adjusted under 35 U.S.C. 154(b) by 0 days.

(21) Appl. No.: 09/854,433

(22) Filed: May 10, 2001

(65) Prior Publication Data

US 2001/0040208 A1 Nov. 15, 2001

Related U.S. Application Data

(60) Provisional application No. 60/203,519, filed on May 10, 2000.

(51) Int. Cl.[7] ..... F16M 13/00
(52) U.S. Cl. ..... 248/519
(58) Field of Search ..... 248/131, 135, 248/519, 511, 521, 539, 507, 910; 135/15.1, 20.3, 20.1; 188/31

(56) References Cited

U.S. PATENT DOCUMENTS 3,119,588 A * 1/1964 Keats ..... 248/158
5,735,632 A * 4/1998 Braverman ..... 404/6
5,765,582 A * 6/1998 Molnar, VI ..... 135/16
5,893,547 A * 4/1999 Cohen, Jr. ..... 248/521
5,937,882 A * 8/1999 Harbaugh ..... 135/20.3
6,196,242 B1 * 3/2001 Xu ..... 135/20.1
6,196,407 B1 * 3/2001 Liu ..... 220/263
6,220,261 B1 * 4/2001 Glatz ..... 135/20.3
6,290,047 B1 * 9/2001 Adamezyk et al. ..... 192/219.5
2001/0042669 A1 * 11/2001 Arakawa ..... 192/219.5

* cited by examiner

*Primary Examiner*—Ramon O. Ramirez
*Assistant Examiner*—Kofi Schulterbrandt
(74) *Attorney, Agent, or Firm*—Raymond Y. Chan; David & Raymond Patent Group

(57) ABSTRACT

A rotation locker stand for outdoor umbrellas includes a rotor, which is rotatably disposed in a chamber of a base housing, including a rotor axial socket for securely and uprightly holding a shaft of the outdoor umbrella, and an actuator for detachably and selectively engaging with the rotator in such a manner when the actuator is engaged with the rotor, the rotor is in the lock up position, when the actuator is disengaged with the rotor, the rotor is adapted for freely rotating along the chamber.

25 Claims, 4 Drawing Sheets

ROTATION LOCKER STAND FOR OUTDOOR UMBRELLAS

CROSS REFERENCE TO RELATED PRIOR APPLICATIONS

This is a regular application of a provisional application No. 60/203,519, filed May 10, 2000.

BACKGROUND OF THE PRESENT INVENTION

1. Field of Invention

The present invention relates to outdoor umbrellas, an more particularly to a rotation locker stand for outdoor umbrellas which is facilitated to safety rotate a shaft of the umbrella at an optimum angle, so as to give a pleasant shade for a user.

2. Description of Related Arts

Conventional outdoor umbrellas are generally divided into two categories: one is the standing type outdoor umbrella and another is the suspended type outdoor umbrella. No matter which type of the outdoor umbrella belonged to, they all comprise a stand having a heavy weight for securely supporting the frame of the umbrella in such a stable manner. The stand of the outdoor umbrella is usually made of steel or concrete that provides a relatively heavy weight, approximate 50 to 60 lbs, at the base of the outdoor umbrella such that the outdoor umbrella will not accidentally fall down especially when an awning of the outdoor umbrella withstands the gusty wind.

However, the stand of the conventional outdoor umbrella has its drawbacks. The stand is too heavy for a user, especially a lady, to carry. From sunrise to sunset, the sunlight fell on the ground keeps changing at the time. In order to obtain the optimum shade from the outdoor umbrella, the user has to move the entire outdoor umbrella back and forth. Due to the heavy weight of the stand, the user always has difficulty to move the outdoor umbrella.

Furthermore, the most common material for making the stand of the outdoor umbrella is steel. In order to provide a certain weight for the stand, 50 to 60 bounds of steel are needed for making only one stand of the outdoor umbrella. It is so costly that the manufacturing cost may highly increase because of such material. Thus, it wastes our valuable resource as well.

An improved outdoor umbrella has a rotatable shaft mounted on the stand wherein the awning is driven by the rotatable shaft in order to provide a better angle of the awning for shading. The shaft is freely rotated on the stand such that the awning is driven to turn coaxially to the stand. However, by turning the awning around through the rotatable shaft, even the outdoor umbrella can provide a better shade area, the awning tends to turn around itself because the shaft has not been locked up from the stand in a rotatably movable manner. So, the outdoor umbrella may not capable of provide the optimum result of shading.

Moreover, even though the outdoor umbrella comprises a locker for locking up the rotation of the shaft, the shaft and the awning of the outdoor umbrella are heavy that the user may hard to rotate. In other words, the shaft of the outdoor umbrella is hard for the user to turn to regulate the optimum shading area.

SUMMARY OF THE PRESENT INVENTION

A main object of the present invention is to provide a rotation locker stand for outdoor umbrellas wherein a shaft of the outdoor umbrella is normally in a lock up position, so as to prevent any unwanted rotation of an awning.

Another object of the present invention is to provide a rotation locker stand for outdoor umbrellas wherein the shaft of the outdoor umbrella is freely to rotate in an unlocked position, so as to provide an optimum shading area.

Another object of the present invention is to provide a rotation locker stand for outdoor umbrellas wherein a base housing comprises a plurality of tray for placing a material so as to provide the weight of the base housing in such a manner when the material is removed from the trays, the weight of the outdoor umbrella is highly reduced such that the user is able to move the entire outdoor umbrella easily.

Accordingly, in order to accomplish the above objects, the present invention provides a rotation locker stand for outdoor umbrellas, comprising:

a shaft having an awning supported at a top end portion thereof for providing a shading area, a base housing comprising a chamber provided thereon for securely and uprightly supporting the outdoor umbrella, a rotor rotatably disposed in the chamber of the base housing comprising a rotor axial socket, which is coaxially mounted thereon, adapted for securely holding the shaft at a lower end portion thereof, and an actuator mounted in the chamber for detachably and selectively engaging with the rotator in such a manner when the actuator is engaged with the rotor, the shaft is in the lock up position, when the actuator is disengaged with the rotor, the rotor is adapted for freely rotating along the chamber.

DETAILED DESCRIPTION OF THE PREFERRED EMBODIMENT

Figure 1:
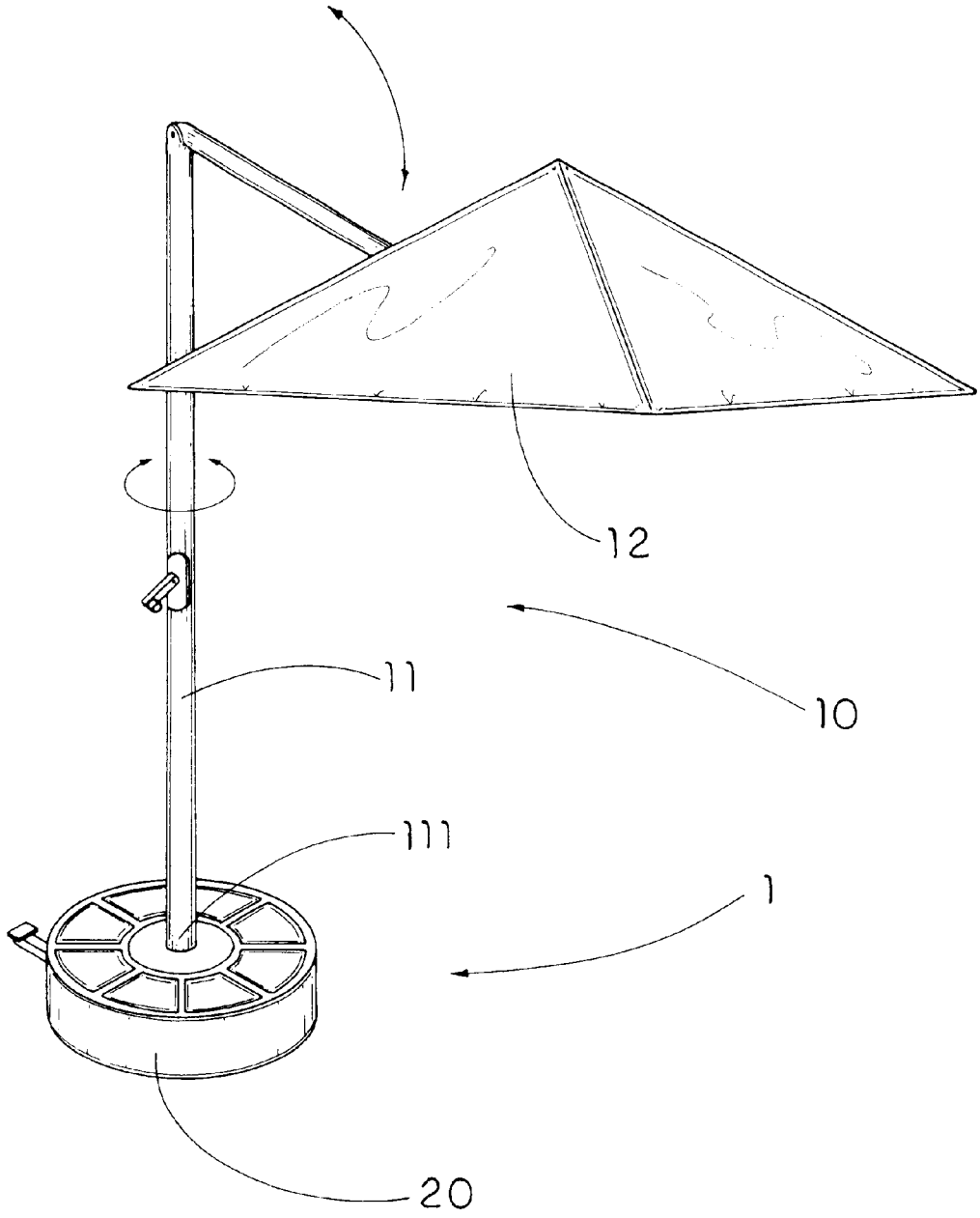
FIG. 1 is a perspective view of a rotation locker stand for outdoor umbrellas according to a preferred embodiment of the present invention.
Figure 2:
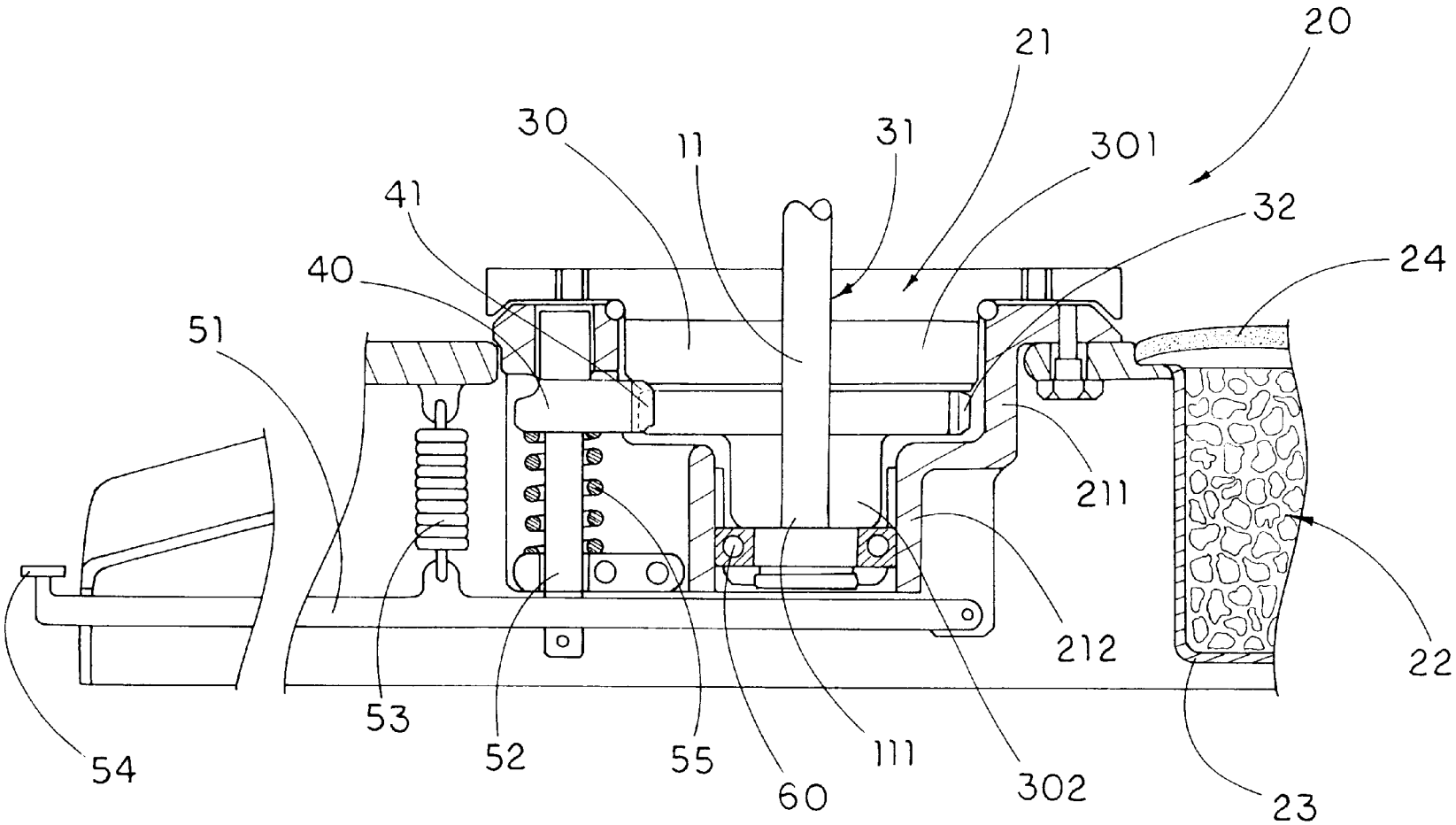
FIG. 2 is a sectional view of the rotation locker stand for outdoor umbrellas according to the above preferred embodiment of the present invention.
Figure 3:
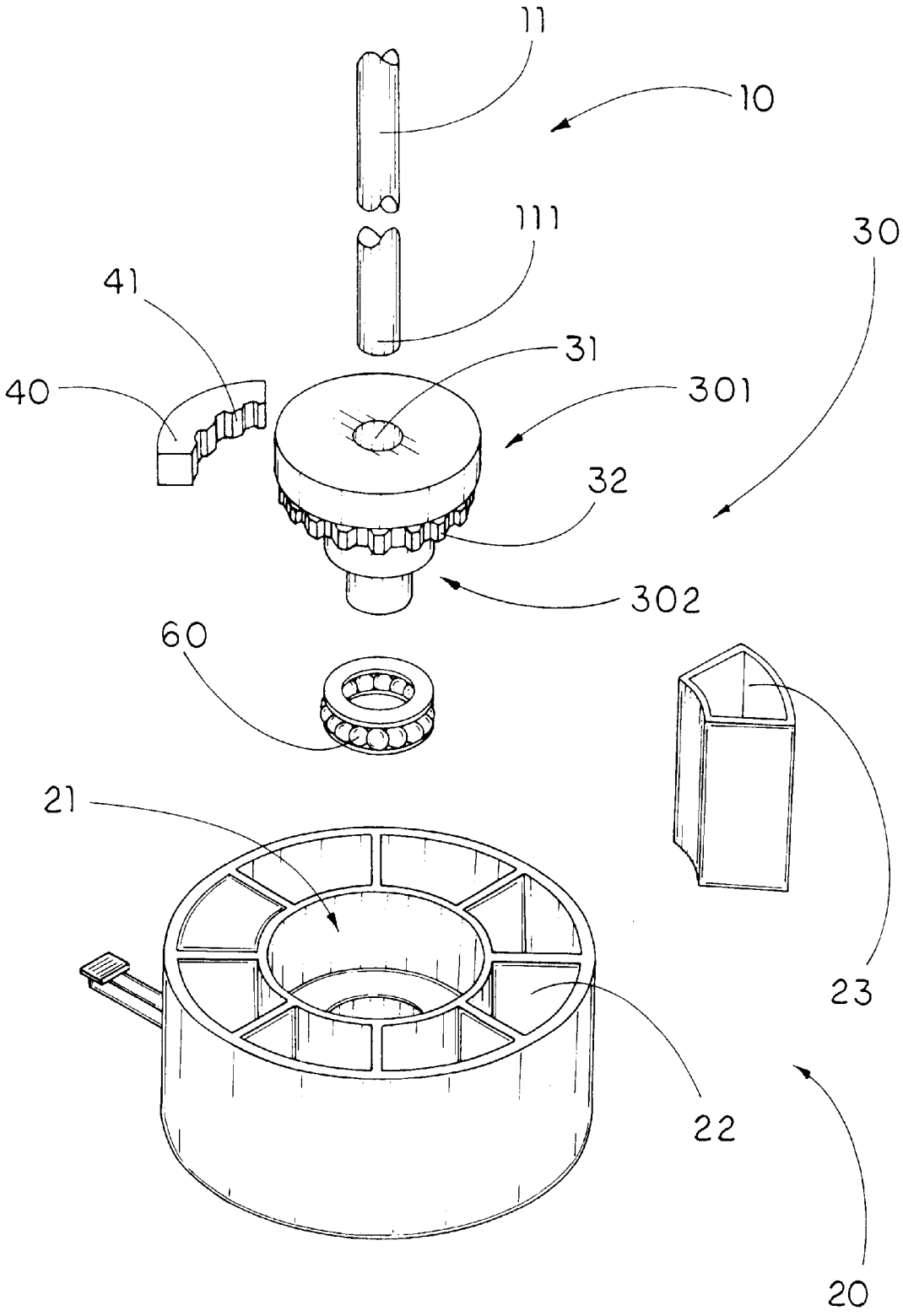
FIG. 3 is an exploded perspective view of the rotation locker stand for outdoor umbrellas according to the above preferred embodiment of the present invention.

Referring to FIGS. 1 to 3 of the drawings, a rotation locker stand 1 for outdoor umbrellas 10 is illustrated, wherein the rotation stand 1 is adapted to be employed with any existing outdoor umbrella. Accordingly, the outdoor umbrella 10 comprises a shaft 11 having an awning 12 supported at a top end portion thereof wherein the awning 12 is arranged to extend in order to provide a shading area. The rotation locker stand 1 is adapted for detachably mounting on the shaft 11 at its lower end portion 111 such that the outdoor umbrella 10 is securely and uprightly supported on the rotation locker stand 1, as shown in FIG. 1.

As shown in FIG. 2, the rotation locker stand 1 comprises a base housing 20 comprising a chamber 21 coaxially provided thereon for securely supporting the outdoor umbrella 10, a rotor 30 rotatably disposed in the chamber 21 of the base housing 20 comprising a rotor axial socket 31, which is coaxially mounted thereon, adapted for securely holding the shaft 11 at the lower end portion 111 thereof, and an actuator 40 mounted in the chamber 21 for detachably and selectively engaging with the rotator 30 in such a manner when the actuator 40 is engaged with the rotor 30, the shaft 11 is in the lock up position, and when the actuator 40 is disengaged with the rotor 30, the rotor is adapted for freely rotating along the chamber 21.

According to the preferred embodiment, the base housing 20 has a circular shape wherein a predetermined weight is added on thereon in order to securely support the outdoor umbrella 10. The cylindrical chamber 21 is coaxially mounted on the base housing 20 wherein the chamber 21 has an upper portion 211 and a lower portion 212 coaxially extended therefrom. The lower portion 212 of the chamber 21 has a diameter smaller than a diameter of the upper portion 211 thereof.

Referring to FIG. 3 of the drawing, the cylindrical rotor 30 has an upper first portion 301 and a lower second portion 302, wherein the first portion 301 and the second portion 302 of the rotor 30 are respectively arranged to fitly dispose in the upper portion 211 and the lower portion 212 of the chamber 21 of the base housing 20. The rotor axial socket 31 is coaxially mounted on the rotor 30 wherein the rotor axial socket 31 has a diameter slightly larger than a diameter of the shaft 11 such that the lower end portion 111 of the shaft 11 is securely inserted into the rotor axial socket 31 for uprightly holding the outdoor umbrella 10. Thus, the rotor 30 is arranged to be driven by the outdoor umbrella 10 to rotate through the shaft 11. In other words, if the rotor is blocked to rotate, it will block the rotation of the shaft 11 as well.

The actuator 40 having an arc shaped is coaxially and slidably disposed in the chamber 21 at its inner circumference wherein the actuator 40 is adapted for detachably and selectively engaging with the rotator 30 at an outer circumference thereof in such a manner when the actuator 40 is engaged with the rotor 30, the rotor 30 is in the locking position.

Figure 4:
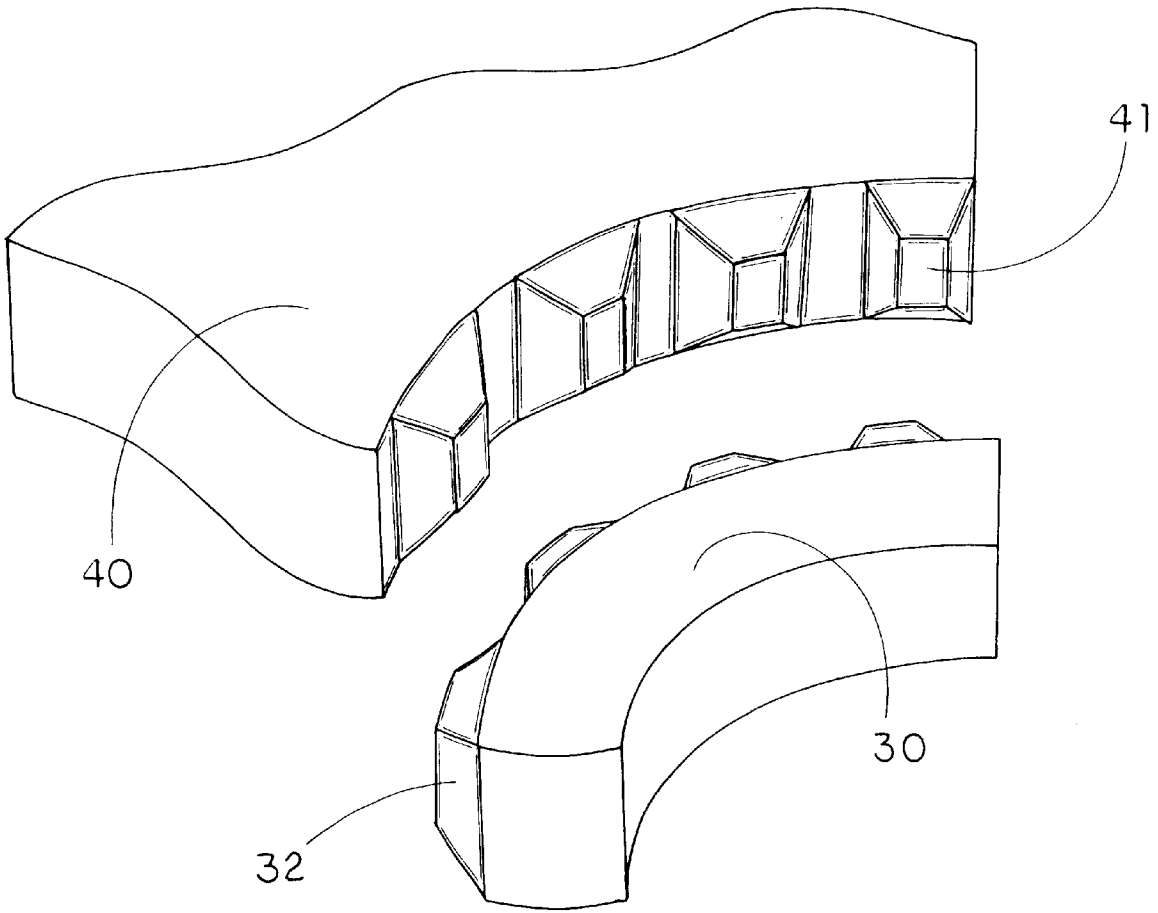
FIG. 4 is a partially perspective view of the rotation locker stand for outdoor umbrellas according to the above preferred embodiment of the present invention, illustrating the engaging teeth and the receiving teeth each having a tapered shaped.

In order to provide a better engagement between the rotor 30 and the actuator 40, the rotor 30 further comprises a plurality of engaging teeth 32 formed in ring shaped wherein the engaging teeth 32 are evenly mounted on the first portion 301 of the rotor 30 at its outer circumference for detachably and selectively engaging with a plurality of corresponding receiving teeth 41 evenly mounted on the actuator 40 at an inner surface thereof. When the engaging teeth 32 of the rotor 30 is engaged with the receiving teeth 41 of the actuator 40, the rotor 30 is positioned in a locking condition, that is blocked the rotation of the rotor 30. Thus, each of the engaging teeth 32 and the receiving teeth 41 has a tapered shape such that the receiving teeth 41 are easily engaged with the engaging teeth 32 with their slope surfaces, as shown in FIG. 4.

According to the preferred embodiment, the actuator 40 is arranged to be driven in a vertically movable manner wherein when the actuator 40 is in the normal highest position, the receiving teeth 41 are engaged with the engaging teeth 32. When a downward force is applied on the actuator 40 in order to pull the actuator 40 downwardly along the chamber 21, the receiving teeth 41 is disengaged with the engaging teeth 32.

In order to apply the downward force on the actuator 40, as shown in FIG. 2, the rotation locker stand 1 further comprises a switching means 50, for selectively engaging and disengaging said actuator 40 with said rotor 30, comprising a first lever 51 pivotally mounted at a bottom portion of the base housing 20, a second lever 52 pivotally connected between the actuator 40 and the first lever 51, a spring 53 for applying an urging pressure against the first lever 51 so as to normally retain the actuator 40 at the locking position, and a footstep 54.

The first lever 51 of the switching means 50 has two ends wherein one end thereof is pivotally affixed at the bottom portion of the base housing 20. Another free end of the first lever 51 is horizontally extended to outside wherein the footstep 54 is affixed thereon for pivotally rotating the first lever 51. The second lever 52 is pivotally connected between the actuator 40 and the first lever 51 wherein the actuator 40 is arranged to be driven downwardly by pressing down the footstep 54 through the first and second levers 51, 52. The spring 53 is connected between the first lever 51 and a ceiling of the base housing 20, so as to apply the urging pressure against the first lever 51. In other words, when a downward force is applied on the footstep 54, the first lever 51 is rotatably slid downward in order to drive the actuator 40 downwardly through the second lever 52.

The switching means 50 further comprises an additional spring 55 encirclingly mounted on the second lever 52 for ensuring the actuator 40 is engaged with the rotor 30. When the downward force applied on the footstep 54 is released, the spring 53 is then rebounded to its original form and will pull the first lever 51 back to its original position in order to pull the actuator 40 upwardly through the second lever 52. The additional spring 55 is also used to pull the actuator 40 upwardly for ensuring the receiving teeth 41 are engaged with the engaging teeth 32. So, when the actuator 40 is forced upwardly by the additional spring 55, each tapered receiving tooth 41 will slide along the respective tapered engaging teeth 32 for fitly engaging the actuator 40 with the rotor 30, so as to lock up the rotation of the rotor 30.

In order to rotate the rotor 30 easily in the unlocked position, a ball bearing 60 is encirclingly mounted between the lower portion 212 of the chamber 21 and the second portion 302 of the rotor 30, so as to reduce a mutual friction therebetween. So, when the receiving teeth 41 are disengaged with the engaging teeth 32, the rotor 30 is freely rotated within the chamber 21.

As shown in FIG. 2, the base housing 20 further comprises a plurality of cavities 22 provided thereon encircling the chamber 21 wherein a tray 23 is detachably disposed in each cavity 22 for storing a cheap material such as sand or stone in the tray 23, so as to pulling weight on the rotation locker stand 1. Thus, a cover 24 is adapted for not only entirely covering the cavities 22 but also decorating the base housing 20.

In view of the above preferred embodiment, the rotation locker stand 1 of the present invention can be concluded to provide the following advantages:

1. Since the rotor 30 is normally in the locking position wherein the shaft 11 of the outdoor umbrella 10 cannot freely be rotated, the rotation locker stand 1 can prevent any unwanted rotation of the awning 12.
2. The operation of the rotation locker stand 1 is simply and easy. When the user wants to rotate the outdoor umbrella 10, simply step on the footstep 54 for applying a downward force thereon, the receiving teeth 41 of the actuator 40 will disengage the engaging teeth 32 of the rotor 30, the rotor 30 is then freely to rotate. When the outdoor umbrella 10 is adjusted in the best position, by releasing the downward on the footstep 54, the receiving teeth 41 will automatically and fitly engage with the engaging teeth 32. It is worth to mention that the ball bearing 60 will help the user to rotate the rotor 30 through the shaft 11 since the ball bearing 60 can reduce the mutual friction between the rotor 30 and the base housing 20, so as to rotate the rotor 30 easily.

3. The manufacturing cost of the rotation locker stand 1 will highly be reduced since the cost of the material such as sand or stone for giving weight to the rotation locker stand 1 is relatively cheap and such material can be easily found anywhere.

4. The user can easy to move the rotation locker stand 1 anywhere since the material for giving weight is removably stored in the cavities 22 of the base housing 20, when such material is removed from the cavities 22, the weight of the rotation locker stand 1 will highly be decreased such that the user is able to easily move the rotation locker stand 1 to any desired location.

What is claimed is:

1. A rotation locker stand for an outdoor umbrella, which comprises a shaft having an awning supported at a top end portion thereof for providing a shading area, wherein said rotation locker comprises:

a base housing comprising a chamber provided therein for securely and uprightly supporting said outdoor umbrella, a rotor, which is rotatably disposed in said chamber of said base housing, for securely holding said shaft at a lower end portion thereof, wherein a plurality of engaging teeth is evenly provided on an outer circumference of said rotor, and an actuator, which is mounted in said chamber, having a plurality of receiving teeth evenly provided on an inner surface thereof for detachably and selectively engaging with said engaging teeth of said rotor in such a manner that when said actuator is engaged with said rotor, said shaft is in a locking position, and when said actuator is disengaged with said rotor, said rotor is adapted for freely rotating along said chamber.

2. The rotation locker stand, as recited in claim 1, wherein said actuator is arranged to be driven in a vertically movable manner, wherein when said actuator is in a normal highest position, said receiving teeth are engaged with said engaging teeth, when said actuator is driven downwardly along said chamber, said receiving teeth is disengaged with said engaging teeth.

3. The rotation locker stand, as recited in claim 1, wherein each of said receiving teeth and said engaging teeth has a tapered shape.

4. The rotation locker stand, as recited in claim 1, further comprises a ball bearing encirclingly mounted between a lower portion of said chamber and a lower portion of said rotor, so as to reduce a mutual friction therebetween.

5. The rotation locker stand, as recited in claim 1, wherein said actuator having an arc shape is coaxially and slidably disposed in said chamber at an inner circumference of said actuator.

6. The rotation locker stand, as recited in claim 5, wherein each of said receiving teeth and said engaging teeth has a tapered shape.

7. The rotation locker stand, as recited in claim 5, further comprises a ball bearing encirclingly mounted between a lower portion of said chamber and a lower portion of said rotor, so as to reduce a mutual friction therebetween.

8. The rotation locker stand, as recited in claim 5, wherein said base housing further comprises a plurality of cavities encircling said chamber, a tray detachably disposed in each cavity for removably storing material so as to put weight on said rotation locker stand, and a cover for covering said cavities of said base housing.

9. The rotation locker stand, as recited in claim 5, further comprises a switching means for selectively engaging and disengaging said actuator with said rotor, wherein said switching means comprises:

a first lever having a first end pivotally affixed at a bottom portion of said base housing and a second end horizontally extended to outside of said base housing, a footstep affixed at said second end of said first lever for applying a downward force to pivotally rotate said first lever, a second lever pivotally connected between said actuator and said first lever wherein said actuator is arranged to be driven downwardly by pressing down said footstep, and a spring, which is connected between said first lever and a ceiling of said base housing, for applying an urging pressure against said first lever.

10. The rotation locker stand, as recited in claim 9, wherein said switching means further comprises an additional spring encirclingly mounted on said second lever for applying an urging pressure against said actuator so as to normally retain said receiving teeth engaged with said engaging teeth.

11. The rotation locker stand, as recited in claim 5, wherein said actuator is arranged to be driven in a vertically movable manner, wherein when said actuator is in a normal highest position, said receiving teeth are engaged with said engaging teeth, when said actuator is driven downwardly along said chamber, said receiving teeth is disengaged with said engaging teeth.

12. The rotation locker stand, as recited in claim 11, wherein each of said receiving teeth and said engaging teeth has a tapered shape.

13. The rotation locker stand, as recited in claim 11, further comprises a ball bearing encirclingly mounted between a lower portion of said chamber and a lower portion of said rotor, so as to reduce a mutual friction therebetween.

14. The rotation locker stand, as recited in claim 11, further comprises a switching means for selectively engaging and disengaging said actuator with said rotor, wherein said switching means comprises:

a first lever having a first end pivotally affixed at a bottom portion of said base housing and a second end horizontally extended to outside of said base housing, a footstep affixed at said second end of said first lever for applying a downward force to pivotally rotate said first lever, a second lever pivotally connected between said actuator and said first lever wherein said actuator is arranged to be driven downwardly by pressing down said footstep, and a spring, which is connected between said first lever and a ceiling of said base housing, for applying an urging pressure against said first lever.

15. The rotation locker stand, as recited in claim 14, wherein said switching means further comprises an additional spring encirclingly mounted on said second lever for applying an urging pressure against said actuator so as to normally retain said receiving teeth engaged with said engaging teeth.

16. The rotation locker stand, as recited in claim 11, wherein said rotor has a rotor axial socket coaxially formed thereon, which has a diameter slightly larger than a diameter of said shaft, for securely inserting said lower end portion of said shaft into said rotor axial socket in such a manner that said rotor is arranged to be driven by said outdoor umbrella to rotate about said shaft.

17. The rotation locker stand, as recited in claim 16, further comprises a switching means for selectively engaging and disengaging said actuator with said rotor, wherein said switching means comprises:

a first lever having a first end pivotally affixed at a bottom portion of said base housing and a second end horizontally extended to outside of said base housing, a footstep affixed at said second end of said first lever for applying a downward force to pivotally rotate said first lever, a second lever pivotally connected between said actuator and said first lever wherein said actuator is arranged to be driven downwardly by pressing down said footstep, and a spring, which is connected between said first lever and a ceiling of said base housing, for applying an urging pressure against said first lever.

18. The rotation locker stand, as recited in claim 17, wherein said switching means further comprises an additional spring encirclingly mounted on said second lever for applying an urging pressure against said actuator so as to normally retain said receiving teeth engaged with said engaging teeth.

19. The rotation locker stand, as recited in claim 18, wherein said base housing further comprises a plurality of cavities:encircling said chamber, a tray detachably disposed in each cavity for removably storing material so as to put weight on said rotation locker stand, and a cover for covering said cavities of said base housing.

20. The rotation locker stand, as recited in claim 18, further comprises a ball bearing encirclingly mounted between a lower portion of said chamber and a lower portion of said rotor, so as to reduce a mutual friction therebetween.

21. The rotation locker stand, as recited in claim 20, wherein said base housing further comprises a plurality of cavities encircling said chamber, a tray detachably disposed in each cavity for removably storing material so as to put weight on said rotation locker stand, and a cover for covering said cavities of said base housing.

22. The rotation locker stand, as recited in claim 18, wherein each of said receiving teeth and said engaging teeth has a tapered shape.

23. The rotation locker stand, as recited in claim 22, wherein said base housing further comprises a plurality of cavities encircling said chamber, a tray detachably disposed in each cavity for removably storing material so as to put weight on said rotation locker stand, and a cover for covering said cavities of said base housing.

24. A rotation locker stand for an outdoor umbrella, which comprises a shaft having an awning supported at a top end portion thereof for providing a shading area, wherein said rotation locker comprises:

a base housing comprising a chamber provided therein for securely and uprightly supporting said outdoor umbrella, a rotor, which is rotatably disposed in said chamber of said base housing, for securely holding said shaft at a lower end portion thereof, and an actuator, which has an arc shape and is coaxially and slidably disposed in said chamber at an inner circumference of said actuator, for detachably and selectively engaging with said rotor in such a manner that when said actuator is engaged with said rotor, said shaft is in a locking position, and when said actuator is disengaged with said rotor, said rotor is adapted for freely rotating along said chamber.

25. The rotation locker stand, as recited in claim 24, wherein said rotor has a rotor axial socket coaxially formed thereon, which has a diameter slightly larger than a diameter of said shaft, for securely inserting said lower end portion of said shaft into said rotor axial socket in such a manner that said rotor is arranged to be driven by said outdoor umbrella to rotate about said shaft.

* * * * *